US005287937A

United States Patent [19]

Sollami et al.

[11] Patent Number: 5,287,937

[45] Date of Patent: Feb. 22, 1994

[54] DRILL BITS AND THE BLADES THEREFOR

[75] Inventors: Phillip A. Sollami; Jimmie L. Sollami, both of Herrin, Ill.

[73] Assignee: The Sollami Company, Herrin, Ill.

[21] Appl. No.: 905,890

[22] Filed: Jun. 30, 1992

[51] Int. Cl.[5] ..... E21B 10/46

[52] U.S. Cl. ..... 175/427; 175/420.1; 175/432

[58] Field of Search ..... 175/427, 429, 432, 420.1, 175/4.5, 4.7

[56] References Cited

U.S. PATENT DOCUMENTS

| | | | |
|---|---|---|---|
| 3,447,616 | 6/1969 | Granat | 175/420.1 |
| 4,189,013 | 2/1980 | Adams | 175/320 |
| 4,313,506 | 2/1982 | O'Connell | 175/410 |
| 4,334,585 | 6/1982 | Upton | 175/432 |
| 4,398,611 | 11/1983 | Sarin | 175/413 |
| 4,492,278 | 1/1985 | Leighton | 175/410 |
| 4,711,312 | 12/1987 | Leibee | 175/393 |
| 4,787,464 | 11/1988 | Ojanen | 175/57 |
| 4,817,742 | 4/1989 | Whysong | 175/410 |
| 5,137,398 | 8/1992 | Omori | 408/145 |

FOREIGN PATENT DOCUMENTS

| | | | |
|---|---|---|---|
| 148098 | 9/1952 | Australia | 175/420.1 |

*Primary Examiner*—William P. Neuder

*Attorney, Agent, or Firm*—Patnaude, Videbeck & Marsh

[57] ABSTRACT

A drill bit is provided which has a novel blade having an elongate longitudinal protrusion positioned axially along the centerline of one side of the blade. The body is adapted to retain the blade in a transverse slot on one end of the body. The slot is provided with a centrally located longitudinal recess along one of the sides of the slot which is adapted to receive the longitudinal protrusion of the blade when the blade is positioned in the slot.

11 Claims, 2 Drawing Sheets

DRILL BITS AND THE BLADES THEREFOR

The present application relates to drill bits, and specifically to a drill bit having a blade with an enlarged mid-section and a body having a grooved slot for retaining and centering the blade.

BACKGROUND OF THE INVENTION

Drill bits adapted to bore through rock for the installation of roof mounts in mines and the like have a hardened carbide blade mounted in a transverse slot at the distal end of an elongate hollow tubular body. The body also has access ports communicating with the inner bore, located adjacent the distal end of the body. The blades of such drill bits are adapted to drill a hole having a diameter of approximately one inch and larger into the stone roof of a mine. A vacuum may be drawn through the hollow drill bit such that stone cuttings removed by the blade are drawn through the ports, through the hollow shaft of the drill bit, and to a collection location remote from the drilling.

Alternately, a water flushing system may be used in which pressurized water is force through the drill steel and out the ports to wash the cuttings out the mouth of the hole.

Presently, it is the practice to attach a drill blade in the slot at the distal end of a drill body by brazing. Prior to being brazed, however, the blade may easily slide from side to side within the slot, and as a result the blade is frequently brazed into a position which is not centered within the slot with respect to the axis of rotation of the drill bit during use thereof.

The blades of such drill bits are subjected to extreme forces causing stresses within the blade which frequently result in breakage of the blade and failure of the bit. The failure of the blade is frequently attributable to improper alignment of the blade on the distal end of the drill bit body, but may also occur as a result of the excessive thrust applied to the blade during the drilling operation. Frequently, failure of a drill bit occurs when the blade first fractures along its longitudinal centerline.

It would be desirable to provide an improved drill bit blade and drill bit body which would reduce the incidences of misalignment of the blade at the distal end of the body, and further would provide greater thrust bearing capacity in the center portion of the blade, thereby reducing the incidences of failure of the drill bit, and extending the life thereof.

BRIEF DESCRIPTION OF THE INVENTION

Briefly, the present invention is embodied in a novel drill bit having a blade and body adapted to centrally locate the blade on the axis of rotation of the bit. The blade has two parallel planar sides and the thickness of the blade is complementary to the thickness of a transverse slot at one end of the body such that the blade will be slidably received within the slot for mounting therein prior to the brazing operation. In accordance with the present invention, at least one elongate longitudinal protrusion is disposed axially along the center of one side of the blade, and the longitudinal protrusion is received within a complementary longitudinal recess in the adjacent wall of the slot.

An important feature of the present invention is that the protrusion is bevelled and slopes inward at the cutting edge of the blade such that the outer surface of the protrusion converges toward the center of the cutting edge. The sloped surface of the protrusion extends to the cutting edge of the blade and reduces the thickness thereof at the center of the cutting edge.

In the preferred embodiment, the drill bit body is provided with an inner bore extending axially from the opposite end of the body, which is opposite the slotted end adapted to retain the blade, and a port in the side of the body communicates with the bore.

A blade having one or two protrusions in accordance with the present invention is strengthened in the central section thereof and is automatically centered when the planar faces of the blade are positioned within the slot and the protrusions on the blade are positioned within the longitudinal recesses of the body. Furthermore, the bevelled sides of the blade adjacent to the cutting edge reduces the force needed to achieve a desired degree of penetration.

GENERAL DESCRIPTION OF THE DRAWINGS

Further objects and advantages and a better understanding of the present invention will be had by reference to the following detailed description taken in connection with the accompanying drawings wherein.

DETAILED DESCRIPTION OF THE PREFERRED EMBODIMENT OF THE INVENTION

Figure 4:
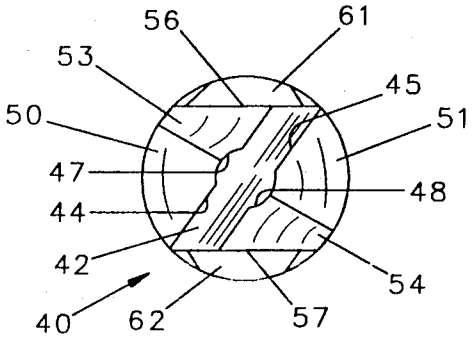
FIG. 4 is a top view of the drill body shown in FIG. 3.
Figure 3:
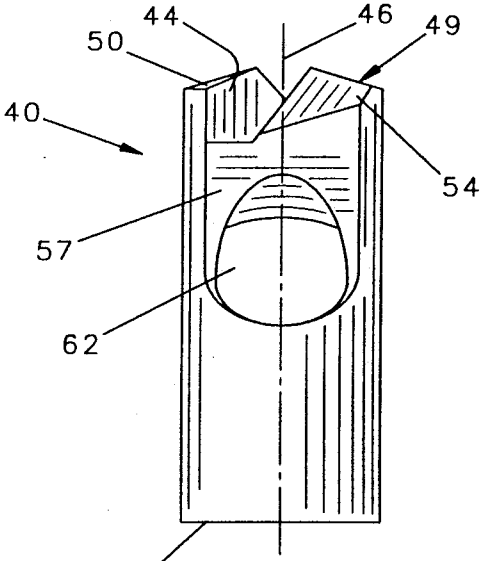
FIG. 3 is a side elevational view of a drill body in accordance with the present invention.
Figure 1:
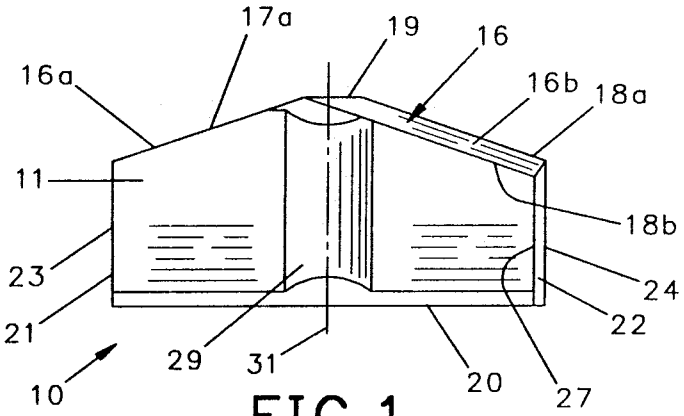
FIG. 1 is a front elevational view of a blade in accordance with the present invention.
Figure 2:
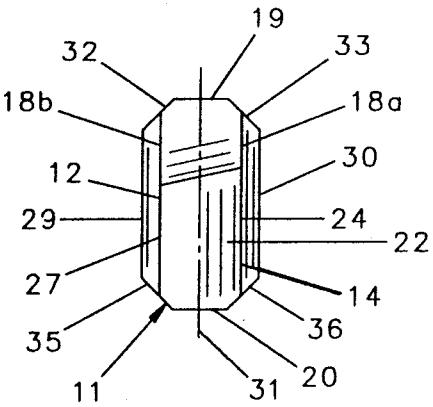
FIG. 2 is a side elevational view of the blade shown in FIG. 1.
Figure 8:
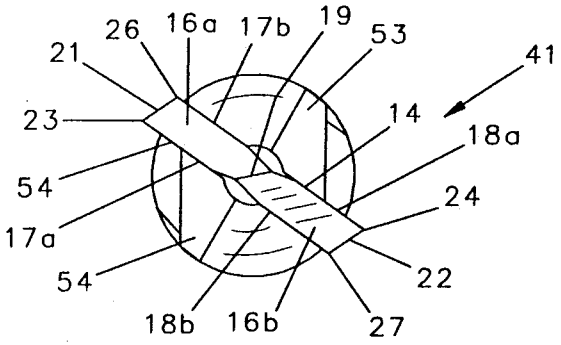
FIG. 8 is a top view of the blade shown in FIG. 1 fitted into the body shown in FIG. 3.

Referring to FIGS. 1, 2 and 8, a drill bit blade 10 is in accordance with the present invention is generally made of tungsten carbide and has a body 11 with two opposing substantially parallel planar sides 12, 14. At one end of the blade 10 is a cutting edge 16 which has first and second angled portions 16*a*, 16*b*, respectively. As can be best seen in FIGS. 2 and 8, the planes of the angled portions 16*a*, 16*b* are not perpendicular to the planar sides 12, 14, but are at a small angle relative thereto such that the leading edges 17*a*, 18*a* of the cutting edge 16 are elevated above the trailing edges 17*b*, 18*b*. As a result of the planes of portions 16*a*, 16*b* not being perpendicular to the faces 12, 14 of the blade 10, the apex 19 of the blade 10 is an angular line best shown in FIG. 8.

The blade 10 further has at the end opposite the cutting edge 16 a seating edge 20, and perpendicular to the seating edge 20, parallel side edges 21, 22. Although the side edges 21, 22 are somewhat parallel to each other, they are not perpendicular to the planar faces 12, 14 of the blade, but are angled such that the leading edges 23, 24 extend outwardly relative to the trailing edges 26, 27 which are retracted as best shown in FIG. 8.

To strengthen the mid-section of the blade 10, a longitudinal protrusion 29 extends along the planar side 12 from the apex 19, adjacent the longitudinal axis 31, to the seating edge 20 midway between the side edges 23, 24. A similar longitudinal protrusion 30 extends along the planar side 14 thereby providing a thickening of the blade 10 in the central portions thereof. The outer surface of the protrusions 29, 30 have an arcuate cross-section as best shown in FIG. 8. Bevels 32, 33, respectively, are provided at the end of the protrusions 29, 30 near the apex 19 and the bevels slope inwardly so as to converge toward the apex 19. It should be noted that the bevels 32, 33 slope into the planar sides 12, 14 of the blade 10, thereby reducing the thickness thereof in the immediate proximity of the apex 19 as best shown in FIG. 8. Bevels 35, 36 are also provided along the seating edge 20 at its intersection with the two sides 12, 14 respectively.

In the preferred embodiment, the width of the blade between the side edges 21, 22 may be one inch and the height of the blade, that is the distance from the seating edge 20 to the apex 19 may be 0.485 inch. In a commercial embodiment of the invention the thickness is between 0.178 inch to 0.184 inch. The perpendicular distance between the termination of the bevels 32, 33 at the apex 19 is approximately 0.125 inches and the angle of the bevels 32, 33, 35, 36 in the preferred embodiment is 45 degrees. The thickness of the blade 10 in the central portion thereof is widened by the protrusions 29, 30 to a maximum thickness of 0.275 inch in the preferred embodiment.

Figure 7:
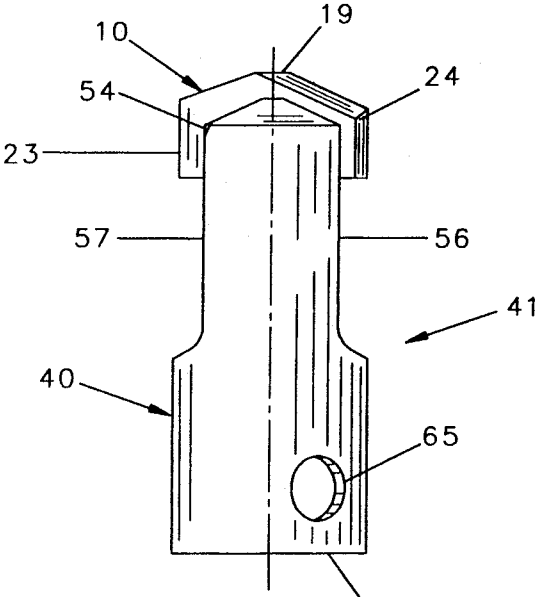
FIG. 7 is a front view of the blade shown in FIG. 1 fitted into the body shown in FIG. 3.

The blade 10 is adapted to fit within a body 40, best shown in FIGS. 3, 4, 5 and 6, and the combined blade 10 and body 40 form a drill bit 41, best shown in FIG. 7 and 8. At one end of the body 40, a transverse slot 42 for mounting the blade 10 is provided having opposing parallel faces 44, 45 the planes of which are parallel to the longitudinal axis 46 of the body 40. The faces 44, 45 of the slot 42 are separated by a distance slightly greater than the thickness of the blade 10 and each of the faces 44, 45 has a centered longitudinal recess 47, 48 respectively therein with arcuate surfaces complementary to the shape of the curves of the surfaces of the protrusions 29, 30 on the blade 10 to provide a loose fit between the blade and the walls of the slot. As a result thereof, the slot 42 is adapted to receive the blade 10 with the seating edge 20 positioned at the bottom of the slot 42 and the faces 12, 14 of the blade 10 fitted between the faces 44, 45 of the slot 42 and the arcuate portions of the protrusions 29, 30, positioned within the recesses 47, 48 as best shown in FIGS. 7 and 8.

The end surface 49 of the body 40 which is adapted to retain the blade 10 is not planar, but has frustoconical surfaces 50, 51 which are adapted to fit behind the trailing edges **17*b*, 18*b* of the blade 10 and transfer force to the blade as torque is applied to the body 40 during drilling. The distance from the bottom of the slot 42 to the frustoconical surfaces 50, 51 is a little less than the distance from the seating edge 20 to the trailing edges 17*b* and 18*b* such that when the blade is fitted in the slot 42, the cutting edge 16 extends well above the frustoconical sections 50, 51. The end surface 49 of the body 40 adjacent the blade 10 also has ramp segments 53, 54, which slope toward the bottom of the slot 42 such that when the blade 10 bores a hole in rock or other substances, a cavity is formed between the walls of the bore and the ramp segments 53, 54. Also, a pair of flats 56, 57 are provided on opposing sides of the body 40 intersecting with the ramp segments 53, 54, such that the cavity formed above the ramp segments 53, 54 extends along the flats 56, 57 and down the sides of the body 40**.

In the preferred embodiment, the body 40 is provided with an axial bore 59 in the other end 60 thereof which is adapted to be fitted on a tubular drill shaft, not shown. A pair of transverse ports 61, 62 extend from the flats 56, 57 to the bore 59, such that cuttings removed by the blade 10 will drop on the ramp segments 53, 54 and fall along the flats 56, 57 and may be drawn by a vacuum through the ports 61, 62 and the bore 59 and down a hollow drill shaft, not shown, to a remote location for accumulation and removal.

Figure 6:
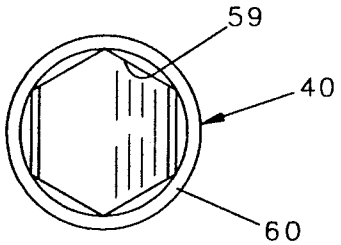
FIG. 6 is a bottom view of the body shown in FIG. 3.
Figure 5:
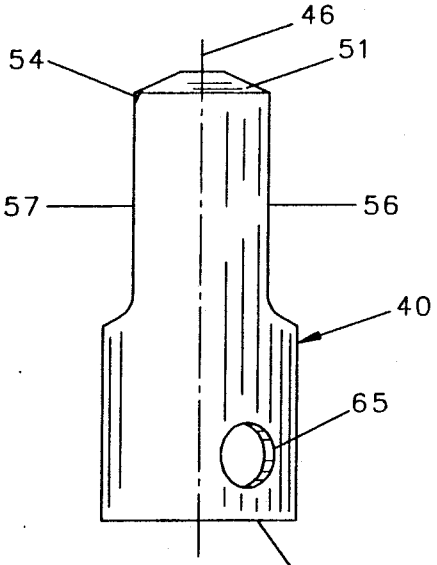
FIG. 5 is a side view of the drill body of FIG. 3 with the body rotated 90 degrees from the position shown in FIG. 3.

As best shown in FIG. 6, the axial bore 59 in the body 40 has a polygon cross-sectional shape with a plurality of surfaces. In the preferred embodiment the cross-sectional shape of the bore 59 is a hexagon and it is adapted to be fitted over the distal end of a drill shaft having a complementary hexagonal cross-sectional shape such that rotational movement from the shaft will be conveyed to the drill body 40 and the blade 10. A transverse hole 65, adjacent the end 60 of the body 40 having the bore 59 therein is adapted to receive a retainer clip (not shown) or any appropriate means to retain the body 40 to a drill shaft.

There is, therefore, provided in accordance with the present invention, an improved blade 10, the central portion thereof which is thickened by the provision of the protrusions 29, 30 thereby to enhance the strength of the blade 10 along the midsection thereof. The protrusions 29, 30 are adapted to slide within the associated complementary recesses 47, 48 of the slot 42 to provide improved centering of the blade 10 at the end 49 of the body 40 to which it is brazed. Furthermore, the bevels 32, 33 which slope towards the apex 19 reduce the thickness of the blade 10 in the proximity of the apex 19 and thereby reduce the thrust required to be applied to the drill bit and the blade to provide the desired penetration in the proximity of the apex 19.

While the present invention has been described in connection with a particular embodiment, it will be appreciated by those skilled in the art that many changes may be made without departing from the true spirit and scope of the present invention. Therefore it is the intent of the appended claims to cover all such changes and modifications which come within the true spirit and scope of this invention.

What is claimed is:

1. A drill bit comprising in combination an elongate body member having a transverse slot at one end thereof, a blade member having a body with cutting edges at one end thereof and a mounting portion at the opposite end thereof which is complementary in cross-section to said transverse slot, said mounting portion being disposed in said transverse slot in said body member, said blade member having a longitudinally extending protrusion disposed on one side of said blade member, said protrusion being received in a recess in one side of said slot, and said protrusion extending to said cutting edge of said blade member.

2. A drill bit according to claim 1, wherein said blade member has a second longitudinally extending protrusion disposed on the side of said mounting portion opposite said one side, said protrusions being centrally located on said blade member, said second longitudinally extending protrusion being received in a second recess in the other side of said slot, said second protrusion extending to said cutting edge of said blade.

3. A drill bit according to claim 2 wherein the ends of said protrusion disposed closest to said cutting edge slope inwardly toward the longitudinal axis of said body.

4. The drill bit according to claim 1 wherein said protrusion has an outer surface which is arcuate in cross-section.

5. The drill bit according to claim 2 wherein said protrusions each have an outer surface which is arcuate in cross-section.

6. The drill bit according to claim 5 wherein said mounting portion of said blade member and said transverse slot in said body member are generally rectangular in cross-section.

7. A drill bit according to claim 3 wherein:

said cutting edge of said blade has centrally located apex, and said sloping ends of said protrusions closes to said cutting edge converge toward said apex.

8. A drill bit comprising in combination an elongate body member having a transverse slot at one end thereof, a blade member having a body with cutting edges converging to a centrally located apex at one end thereof and a mounting portion at the opposite end thereof which is complementary in cross-section to said transverse slot, said mounting portion being disposed in said transverse slot in said body member, said blade member having a longitudinally extending protrusion disposed on each side thereof, said protrusions being received in complementary shaped recesses in each said of said slot, said protrusions extending to said apex of said cutting edges, a longitudinal bore extending into the other of said ends of said body, and a port in said body communicating with said bore.

9. A drill bit according to claim 8 wherein said protrusions have outer surfaces which slope toward said apex at the ends of said protrusions near said apex.

10. The drill bit according to claim 9 wherein said elongate body further comprises a ramp segment on said one end thereof, and a flat on the side of said body extending from said ramp segment to said port.

11. A drill bit according to claim 8 wherein said blade is made of tungsten carbide.

* * * * *

UNITED STATES PATENT AND TRADEMARK OFFICE

CERTIFICATE OF CORRECTION

PATENT NO. : 5,287,937

DATED : February 22, 1994

INVENTOR(S) : Phillip A. Sollami and Jimmie L. Sollami

It is certified that error appears in the above-indentified patent and that said Letters Patent is hereby corrected as shown below:

In column 6, line 26, after "claim" delete "8" and substitute --10--.

Signed and Sealed this

Second Day of August, 1994

Bruce Lehman

*Attest:*

BRUCE LEHMAN

*Attesting Officer*

*Commissioner of Patents and Trademarks*